US005574339A

United States Patent [19]

Kattwinkel et al.

[11] Patent Number: 5,574,339

[45] Date of Patent: Nov. 12, 1996

[54] DRIVE FOR ROCKING FURNITURE

[75] Inventors: Marcus Kattwinkel, Halver; Martin Zagromski, Dortmund, both of Germany

[73] Assignee: Matt Kattwinkel, Halver, Germany

[21] Appl. No.: 471,280

[22] Filed: Jun. 6, 1995

[30] Foreign Application Priority Data

Jun. 6, 1994 [DE] Germany ..... 44 19 781.0

[51] Int. Cl.[6] ..... A47C 3/02

[52] U.S. Cl. ..... 318/10; 318/127; 318/282; 318/286; 5/109; 297/260.1

[58] Field of Search ..... 5/101, 105, 108, 5/109; 318/9, 10, 11, 14, 119, 121, 126–130, 280, 281, 282, 283, 286; 297/260

[56] References Cited

U.S. PATENT DOCUMENTS

| | | | |
|---|---|---|---|
| 3,737,924 | 6/1973 | Davis | 5/108 |
| 3,842,450 | 10/1974 | Pad | 5/108 |
| 3,952,343 | 4/1976 | Wong | 5/109 |
| 4,028,753 | 6/1977 | Rios | 5/108 |
| 4,392,092 | 7/1983 | Gassner | 318/127 |
| 4,590,631 | 5/1986 | Varney | 5/101 |
| 4,775,184 | 10/1988 | Larkin | 297/260 |
| 4,911,499 | 3/1990 | Meeker | 297/260 |
| 4,957,302 | 9/1990 | Maxwell | 280/32.6 |
| 5,020,170 | 6/1991 | Ruf | 5/61 |
| 5,103,511 | 4/1992 | Sequin | 5/607 |
| 5,303,433 | 4/1994 | Jang | 5/109 |
| 5,368,361 | 11/1994 | Wen-Ming | 297/260 |

FOREIGN PATENT DOCUMENTS

| | | |
|---|---|---|
| 7520683 | 7/1976 | Germany . |
| 3042314 | 5/1981 | Germany . |
| 3530527 | 9/1987 | Germany . |

*Primary Examiner*—Brian Sircus
*Attorney, Agent, or Firm*—Herbert Dubno; Andrew Wilford

[57] ABSTRACT

A piece of furniture has a frame and a part capable of rocking on the frame at a natural rocking frequency. A drive has a sensor for detecting movement of the part on the frame, a drive motor connected between the frame and the part for rocking the part on the frame, and a controller connected between the drive and sensor for rocking the part on the frame at the natural rocking frequency up to a predetermined maximum angular displacement of the part on the frame. The sensor detects angular movement, that is angular speed, angular position, and/or angular acceleration of the part on the frame. The controller has a response field and operates the drive in accordance therewith.

13 Claims, 4 Drawing Sheets

FIG. 3A
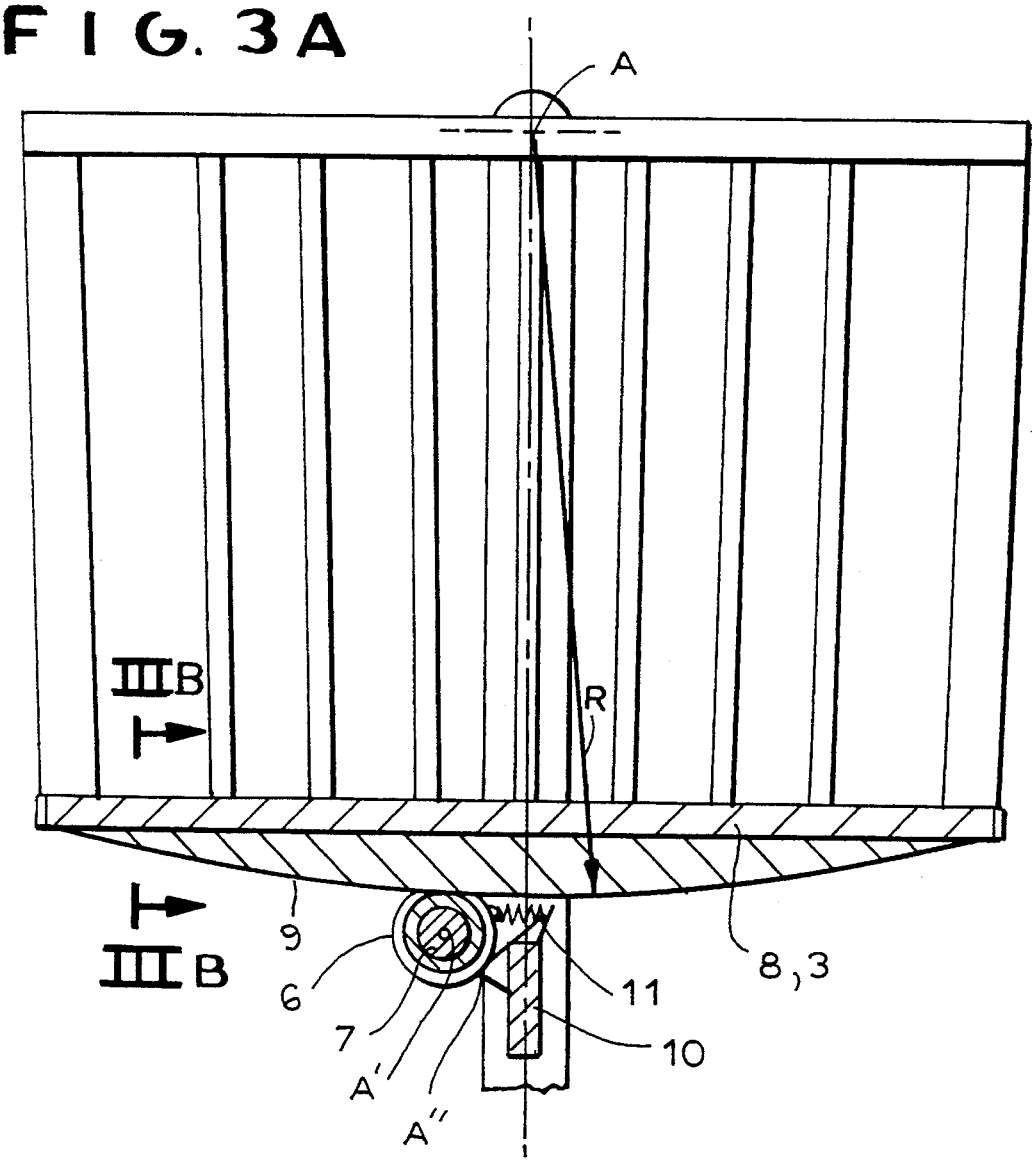
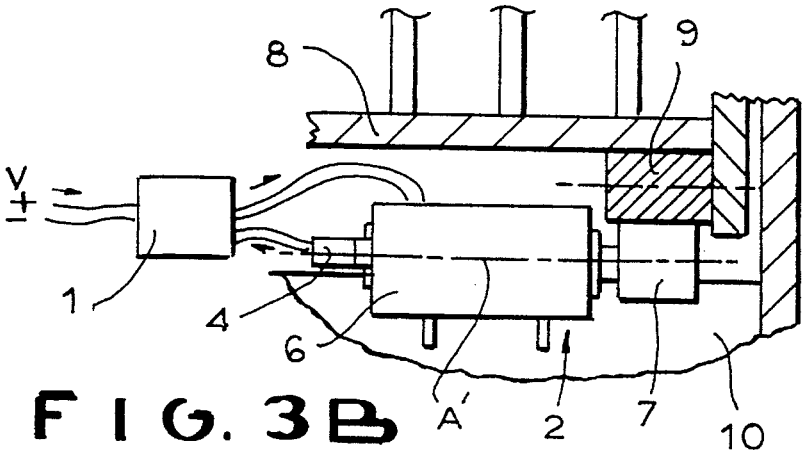
FIG. 3B

DRIVE FOR ROCKING FURNITURE

FIELD OF THE INVENTION

The present invention relates to a drive for rocking furniture. More particularly this invention concerns a drive for a cradle, swing, or the like.

BACKGROUND OF THE INVENTION

A piece of furniture that oscillates about an axis, for instance a baby cradle, Hollywood swing, child's swing, or infant's bed, is typically operated manually either by the user or a person tending the user, but may have some kind of electric or windup drive to prevent the oscillation from degrading, that is the rocking furniture from stopping. The swinging action is often desirable to soothe an infant or to amuse an older user of the rocking furniture.

The typical drive system as described in U.S. Pat. No. 4,028,753 of Rios, German 3,042,314 of Gullilen, or German 3,530,527 of Schmidt has a rotary motor that sits on the ground or on a stationary frame and that drives an eccentric crank arm that is in turn attached to the rocking part of the piece of furniture. Such a system is often very energy inefficient since it imposes a movement on the piece of furniture that is determined by the motor speed and that has no relation to the natural rocking frequency of the item. German utility model 7,520,683 of Buchfelder proposes a potentially adjustable electromagnetic drive intended to follow the furniture's eigenfrequency, that is its natural oscillation frequency, but such systems are normally fairly complex and consume considerable energy.

OBJECTS OF THE INVENTION

It is therefore an object of the present invention to provide an improved drive for rocking furniture.

Another object is the provision of such an improved drive for rocking furniture which overcomes the above-given disadvantages, that is which sets the furniture to oscillating at its natural rocking or eigenfrequency, regardless of whether it is empty, lightly loaded, or heavily loaded.

A further object is to provide such a drive which is simple, energy-efficient, and which can be applied to various types of rocking furniture without significat adaptation.

Another object is the provision of a rocking-furniture drive which ignores disturbances to the rocking, which can start the furniture rocking from a standing stop, and which can be set to a predetermined maximum swing angle to prevent the furniture from tipping over.

SUMMARY OF THE INVENTION

A piece of furniture has a frame and a part capable of rocking on the frame and having a natural rocking frequency. A drive has according to the invention a sensor for detecting movement of the part on the frame, a drive motor connected between the frame and the part for rocking the part on the frame, and a controller connected between the drive and sensor for rocking the part on the frame at the natural rocking frequency up to a predetermined maximum angular displacement of the part on the frame.

The sensor detects angular movement, that is angular speed, angular position, and/or angular acceleration of the part on the frame. The controller has a response field and operates the drive in accordance therewith, using fuzzy logic.

More specifically according to the invention the drive includes an electric motor having a rotary output, and a wheel carried on the output and operatively engaged with the part. The part can oscillate about an axis and carry a drive rail having an arcuate surface generally centered on the axis and engaging the wheel. A spring urges the wheel radially against the surface. Alternately the drive includes a straight bar having one end pivoted on the part and an edge bearing against the wheel. The bar can be a rack and the wheel a gear meshing with the rack for positive driving and accurate positioning of the part.

In a system without a physical part defining the pivot axis the frame has at least one upwardly concave and circularly arcuate rail and the part has wheels riding on the rail so that the rail has a center of curvature that defines a virtual axis for rocking of the part.

The sensor can a tachometer or potentiometer connected to the part. Either device can produce an output from which the speed and acceleration of the part can be derived.

Since the time and amount of energy supplied to the drive motor is set based on an evaluation of the movement of the part in accordance with a rational program, it is possible to determine and work with the natural rocking frequency of the part. Since according to this invention the eigenfrequency or natural frequency of the part is always used the amount of energy needed to maintain the oscillation is minimal, merely enough to overcome frictional and other losses. Limiting the maximum angular travel is easily accomplished regardless of the motor characteristic curve and other parameters.

The eigenfrequency of the movable part is the reciprocal of the duration of one full-length oscillation. Thus if the part takes 2 sec to travel from end to end the frequency is ½ stroke/sec. This is dependent on the distance between the center of mass of the part and the axis about which it rotates. The speed of travel is roughly proportional to the mass of the part, that is if the part is loaded it will move more rapidly than if it is empty.

Normally according to the invention a motor is used whose rotor turns freely when the motor is not energized. Thus the motor is used only to give a boost in one direction and idles freely on the return stroke. The controller is set to energize the motor to provide such a boost only when the angular travel falls below a predetermined threshold level. The system can be controlled by a manual or acoustic switch and readings can be taken as the part passes through the bottom or null position.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIG. 3A is an end view of a cradle equipped with the drive of this invention;

FIG. 3B is a view taken in the direction of arrow IIIB of FIG. 3*a;*

SPECIFIC DESCRIPTION

Figure 1:
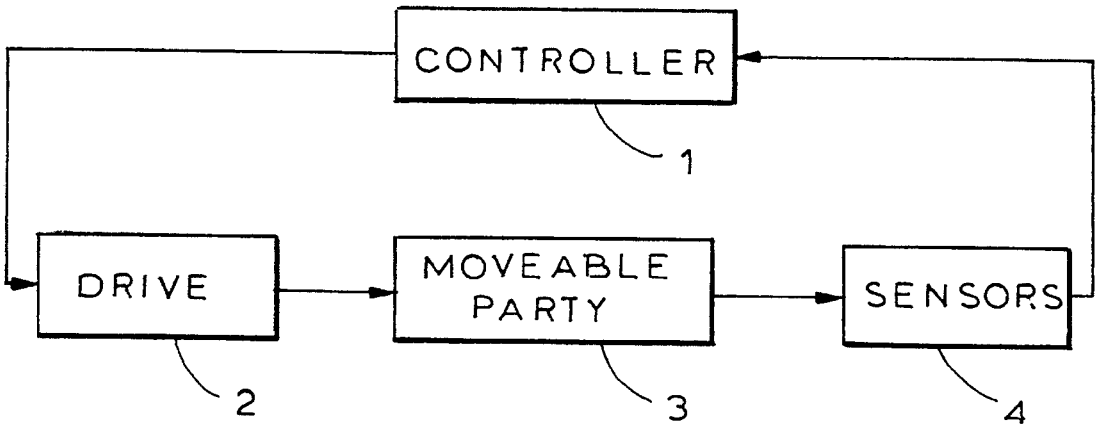
FIG. 1 is a schematic diagram illustrating the system of this invention.

As seen in FIG. 1 a system according to this invention has a microprocessor controller 1 whose output is connected to a drive 2 connected to a movable furniture part 3 in turn connected to a motion sensor 4 whose output is connected to an input of the controller 1. The controller 1 supplies voltage to the motor or drive 2 in accordance with a curve shown at 5 in FIG. 2A which is dependent on the angular speed and angular displacement of the movable part 3. The voltage is maximized at the center or node point of the displacement of the part's displacement and decreases to zero in each direction as the rocking part moves to the end of its angular stroke, and is only effective in one direction of displacement of the part 3.

FIGS. 3A and 3B show a cradle having a bed 8 constituting a movable part 3 pivotal about a horizontal axis A relative to a frame 10. The bottom of the cradle bed 8 carries an arcuate rail 9 whose lower surface is circularly arcuate and centered on the axis A, that is having a constant radial distance R therefrom. According to the invention a motor 6 has an output wheel or drum 7 rotatable about an axis A' parallel to the axis A and forming with the motor 6 the drive 2. The opposite end of the motor shaft carries a tachometer constituting the sensor 4 and producing an output that therefore corresponds to the angular speed and position of the cradle bed 8. The motor 6 and its drum 7 are pivotal about an axis A" on the frame 10 and a spring 11 urges the drive 2 angularly about this axis A" to press the drum 7 against the rail 9. Thus the drum 7 frictionally drives the bed 8.

Figure 4:
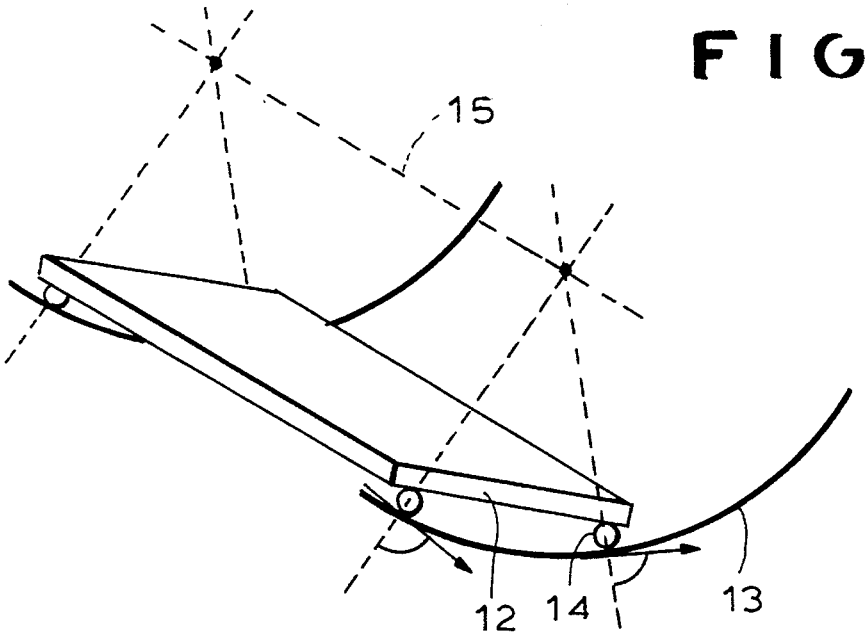
FIG. 4 is a largely schematic diagram illustrating another piece of rocking furniture according to the invention.

FIG. 4 shows how a movable furniture element 12 can ride via rollers 14 on a pair of upwardly circularly arcuate rails 13 so that it in effect rocks about an axis 15 above the element 12. Such an arrangement can be driven like the element 8 of FIGS. 3A and 3B but has a virtual rather than a real axis.

Figure 5:
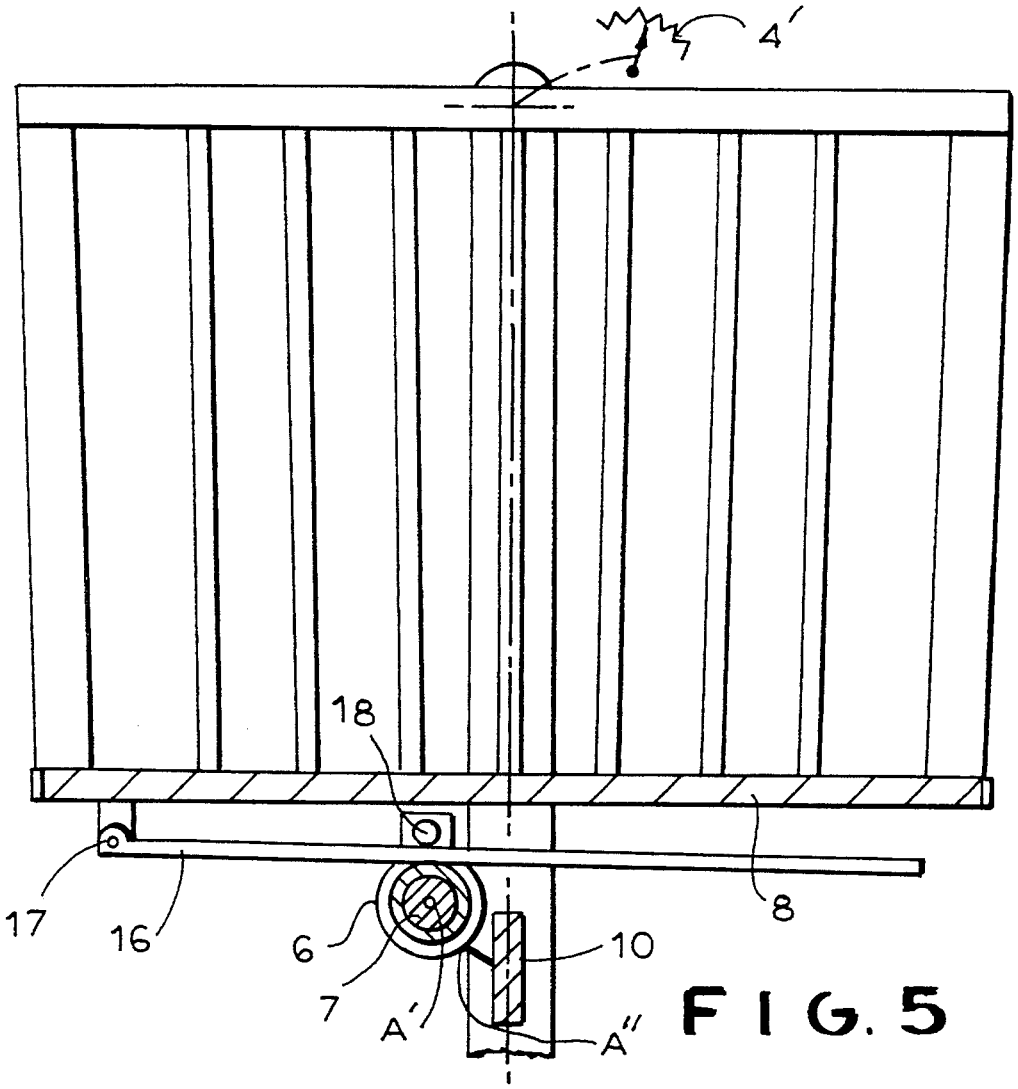
FIG. 5 is a view line FIG. 3A showing another cradle-drive system of this invention.

In FIG. 5 the motor drum 7 grips with an idler wheel 18 a rail 16 that is pivoted at 17 on one end of the movable part 8. The motor 6 cannot pivot on the frame 10 but instead is fixed thereon. Nonetheless the pivoting of the gripped rail 16 allows the rotation of the motor 7 to be transmitted to the movable part 8. The sensor 4 is a potentiometer 4' coupled to the part 8 at the axis A. The controller 1 can derive the position of the part 8 from the resistance of the potentiometer 4' and the speed from the derivative of this resistance as it changes.

More particularly the potentiometer 4' produces an output o from which the controller 1 calculates the angular speed s. By means of these two values the controller 1 produces an output voltage U in accordance with fuzzy logic as illustrated by the envelope 5 of FIG. 2A. For each value of o and s there is a respective value of U. The output U is amplified by an appropriate circuit and fed directly to the motor drive 2, which is a direct-current motor.

Figure 2B:
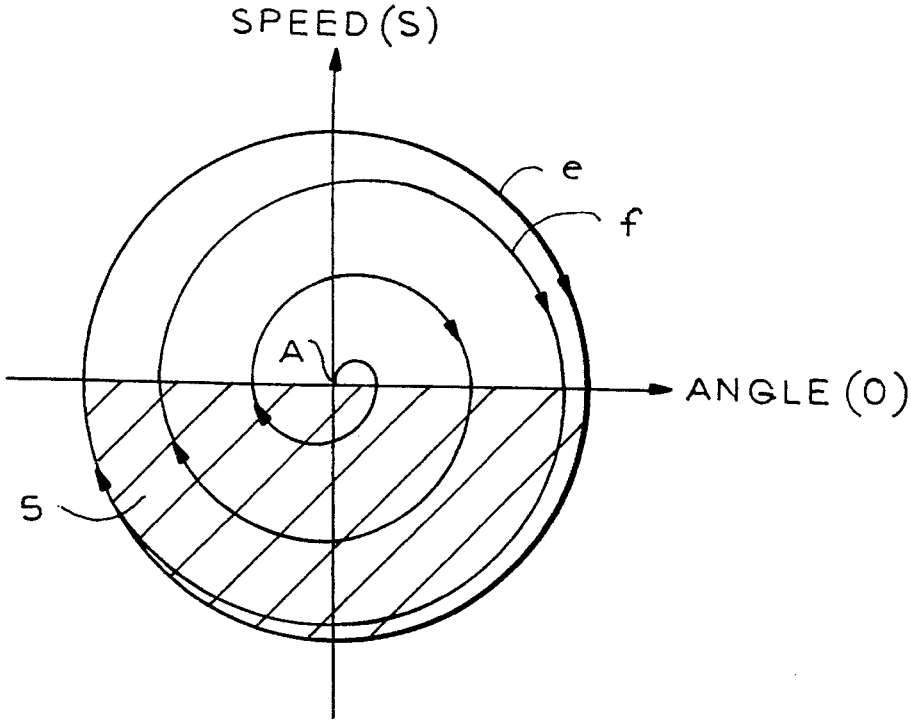
FIGS. 2A and 2B are charts illustrating the response of the controller of the invention.
Figure 2A:
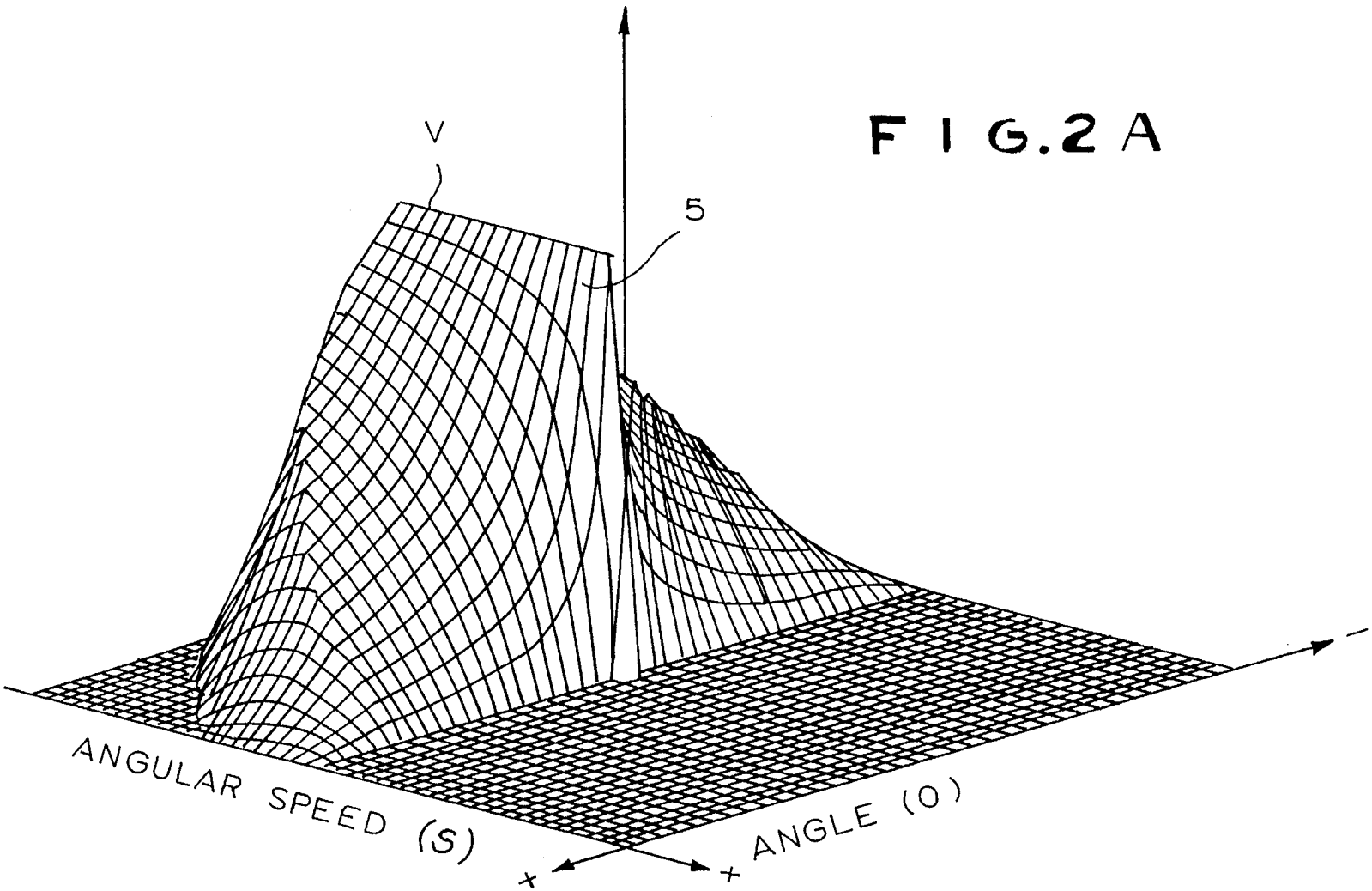

FIG. 2B is a top view of the field 5 of FIG. 2A where outer circle e represents the maximum angular deflection of the part 8 relative to the axis A. Spiral line f shows the increase in swing amplitude and the shaded region 5 corresponds to the envelope 5 of FIG. 2A. According to fuzzy logic:

IF angle o big AND speed s big, THEN U=zero,

IF angle o small AND speed s small, THEN U=medium, and so on for intermediate values to produce the desired smoothly graduated field. Once the swing amplitude reaches the amplitude of circle e, the power boost is eliminated, and when it drops back down to an intermediate value is restored to keep the rocking going within a certain range.

We claim:

1. In combination with a piece of furniture having a frame and a part capable of rocking on the frame about an axis and having a natural rocking frequency, a drive comprising:

sensor means for detecting movement of the part on the frame;

drive means for rocking the part on the frame including a drive rail carried on the part and having an arcuate surface generally centered on the axis, an electric motor having a rotary output, a wheel carried on the output, and spring means urging the wheel radially against the drive-rail surface; and control means connected between the drive and sensor means for rocking the part on the frame at the natural rocking frequency up to a predetermined maximum angular displacement of the part on the frame.

2. The furniture drive defined in claim 1 wherein the sensor detects angular movement of the part on the frame.

3. The furniture drive defined in claim 2 wherein the sensor detects the angular speed of movement of the part on the frame.

4. The furniture drive defined in claim 2 wherein the sensor detects the instantaneous angular position of the part on the frame.

5. The furniture drive defined in claim 1 wherein the controller has a response field and operates the drive in accordance therewith.

6. In combination with a piece of furniture having a frame and a part capable of rocking on the frame and having a natural rocking frequency, a drive comprising:

sensor means for detecting the angular speed of movement of the part on the frame;

drive means connected between the frame and the part for rocking the part on the frame; and control means connected between the drive and sensor means for rocking the part on the frame at the natural rocking frequency up to a predetermined maximum angular displacement of the part on the frame.

7. The furniture drive defined in claim 1 wherein the frame has at least one upwardly concave and circularly arcuate rail and the part has wheels riding on the rail, whereby the rail has a center of curvature that defines the axis.

8. The furniture drive defined in claim 1 wherein the sensor means includes a tachometer connected to the part.

9. The furniture drive defined in claim 1 wherein the sensor means includes a potentiometer connected to the part.

10. The furniture drive defined in claim 6 wherein the drive means further includes an electric motor having a rotary output, a wheel carried on the output, and a straight bar having one end pivoted on the part and an edge bearing against the wheel.

11. In combination with a piece of furniture having a frame and a part capable of rocking on the frame and having a natural rocking frequency, a drive comprising:

sensor means for detecting the instantaneous angular position of the part on the frame;

drive means connected between the frame and the part for rocking the part on the frame; and control means connected between the drive and sensor means for rocking the part on the frame at the natural rocking frequency up to a predetermined maximum angular displacement of the part on the frame.

12. In combination with a piece of furniture having a frame and a part capable of rocking on the frame and having a natural rocking frequency, a drive comprising:

sensor means including a tachometer connected to the part for detecting movement of the part on the frame;

drive means connected between the frame and the part for rocking the part on the frame; and control means connected between the drive and sensor means for rocking the part on the frame at the natural rocking frequency up to a predetermined maximum angular displacement of the part on the frame.

13. In combination with a piece of furniture having a frame and a part capable of rocking on the frame and having a natural rocking frequency, a drive comprising:

sensor means including a potentiometer connected to the part for detecting movement of the part on the frame;

drive means connected between the frame and the part for rocking the part on the frame; and control means connected between the drive and sensor means for rocking the part on the frame at the natural rocking frequency up to a predetermined maximum angular displacement of the part on the frame.

* * * * *